United States Patent [19]

Usami et al.

[11] Patent Number: 4,840,933

[45] Date of Patent: Jun. 20, 1989

[54] HEAT SENSITIVE RECORDING MATERIAL

[75] Inventors: Toshimasa Usami; Seiji Hatakeyama; Akihiro Shimomura, all of Shizuoka, Japan

[73] Assignee: Fuji Photo Film Co., Ltd., Kanagawa, Japan

[21] Appl. No.: 53,788

[22] Filed: May 26, 1987

[30] Foreign Application Priority Data

May 26, 1986 [JP] Japan ..... 61-121875
Dec. 8, 1986 [JP] Japan ..... 61-292160
Apr. 9, 1987 [JP] Japan ..... 62-88197

[51] Int. Cl.[4] ..... B41M 5/18

[52] U.S. Cl. ..... 503/213; 427/150; 427/151; 428/913; 503/215; 503/225; 503/226

[58] Field of Search ..... 427/150–152; 428/913; 503/213–215, 200, 225, 226

[56] References Cited

U.S. PATENT DOCUMENTS 4,087,284 5/1978 Golden et al. ..... 503/207

4,147,830 4/1979 Kato et al. ..... 503/225

*Primary Examiner*—Bruce H. Hess

*Attorney, Agent, or Firm*—Sughrue, Mion, Zinn, Macpeak & Seas

[57] ABSTRACT

A heat sensitive recording material which comprises a support having thereon a heat sensitive layer containing at least color former-contained microcapsules and a color developer, with the heat sensitive layer being formed using a colorless or light colored precursor of a basic dye as the color former, and according to a process which comprises preparing a coating composition by mixing the color former-contained microcapsules with an emulsified dispersion prepared by dissolving at least the color developer into an organic solvent which is slightly soluble or insoluble in water, and then dispersing the solution in an emulsified condition, coating the resulting composition on the support, and then drying the coat, whereby the heat sensitive layer comes to acquire both excellent transparency and high sensitivity to heat.

8 Claims, No Drawings

HEAT SENSITIVE RECORDING MATERIAL

BACKGROUND OF THE INVENTION a. Field of the Invention

The present invention relates to a heat sensitive recording material which comprises a support having thereon a heat sensitive layer and, more particularly, to a heat sensitive recording material which has a heat sensitive layer excellent in transparency.

b. Description of the Prior Art

A heat sensitive recording method has many advantages in that, (1) no particular developing step is required, (2) if paper is used as a support, a recording material prepared can have a quality akin to that of plain paper, (3) handling of a recording material used is easy, (4) images recorded has high color density, (5) this method can be embodied using a simple and cheap apparatus, (6) no noise is generated upon recording, and so on. Therefore, heat sensitive recording materials have recently enjoyed a markedly increasing demand, particularly in the fields of facsimile and printer, and have come to be used for many purposes.

With this background, it has come to be desired to develop transparent heat sensitive recording materials which enables direct recording with a thermal head in order to adapt them for multicolor development, or to make them usable for an overhead projector (hereafter it is written as OHP).

However, conventional transparent heat sensitive recording materials are so-called transparent heat sensitive films in which the film is brought into direct contact with an original and exposed to light, and thereby an infrared portion of the light is absorbed by image areas of the original to raise the temperature of the image areas, which results in color development of the heat sensitive film. Accordingly, they do not have heat sensitivity high enough to enable direct heat recording with a thermal head to be used in facsimile and the like.

In addition, a heat sensitive layer of heat sensitive recording materials of the kind which use a thermal head upon heat recording is in a devitrified condition, so a desired transparency cannot be achieved by merely coating such a layer on a transparent support.

As the result of concentrating our energies on study of heat sensitive recording materials, it has now been found that when a combination of a colorless or light colored precursor of a basic dye and a color developer is employed as color development system, the former is microencapsulated and the latter is emulsified and dispersed under a prescribed condition, and then both are mixed and coated on a support, the heat sensitive layer formed becomes transparent to our surprise, thus achieving the present invention.

SUMMARY OF THE INVENTION

Therefore, a first object of the present invention is to provide a heat sensitive recording material of high heat sensitivity having a transparent heat sensitive layer having high heat sensitivity.

A second object of the present invention is to provide a heat sensitive recording material which has high sensitivity, and can be used for an overhead projector.

A third object of the present invention is to provide a method of coating a heat sensitive layer having high heat sensitivity in a transparent condition.

The above-described objects are attained with a heat sensitive recording material which comprises a support having thereon a heat sensitive layer containing at least color-former-contained microcapsules and a color developer, with the heat sensitive layer being formed using a colorless or light colored precursor of a basic dye as the color former, and according to the process which comprises preparing a coating composition by mixing the microcapsules with an emulsifier dispersion prepared by dissolving at least the color developer into an organic solvent slightly soluble or insoluble in water and then dispersing the solution in an emulsified condition, coating the resulting composition on the support, and then drying the coat.

PREFERRED EMBODIMENT OF THE INVENTION

Precursors of basic dyes to be employed in the present invention are selected properly from known colorless or light colored compounds of the kind which can develop their colors by donating an electron or accepting a proton of an acid or the like. These compounds have such a skeleton as that of lactone, lactam, sultone, spiropyran, ester, amide, etc., as a part of their structures, and these skeletons undergo ring-opening or bond cleavage upon contact with a color developer. Preferred examples of such compounds include triarylmethane compounds, diphenylmethane compounds, xanthene compounds, thiazine compounds, spiropyran compounds and so on.

Particularly preferred compounds are those represented by the following general formula:

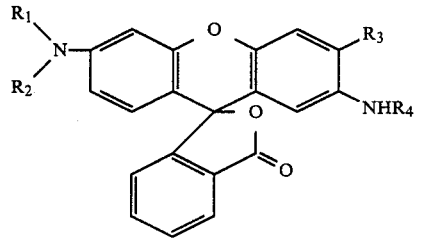

In the foregoing formula, $R_1$ represents an alkyl group containing 1 to 8 carbon atoms; $R_2$ represents an alkyl or alkoxyalkyl group containing 4 to 18 carbon atoms, or a tetrahydrofuryl group; $R_3$ represents a hydrogen atom, an alkyl group containing 1 to 15 carbon atoms, or a halogen atom; and $R_4$ represents a substituted or unsubstituted aryl group containing 6 to 20 carbon atoms. As substituent group for $R_4$, alkyl, alkoxy and halogenated alkyl groups containing 1 to 5 carbon atoms, and halogen atoms are preferred.

Microencapsulation of the above-described color former in the present invention can prevent generation of fog during production of a heat sensitive material and, at the same time, can improve a freshness keeping quality of a heat sensitive material and a keeping quality of the record formed. Therein, the image density at the time of recording can be heightened by properly selecting a material and a method for forming a microcapsule wall. A preferred amount of the color former used is 0.05 to 5.0 g per square meter.

Suitable examples of wall materials for microcapsules include polyurethane, polyurea, polyester, polycarbonate, urea/formaldehyde resin, melamine resin, polystyrene, styrene/methacrylate copolymer, styrene/acrylate copolymer, gelatin, polyvinyl pyrrolidone, polyvinyl alcohol, and so on. These macromolecular substances can be used in combination of two or more thereof in the present invention.

Of the above-cited macromolecular substances, polyurethane, polyurea, polyamide, polyester, and polycarbonate are preferred in the present invention. In particular, polyurethane and polyurea can bring about good results.

Microcapsules to be employed in the present invention are preferably prepared by emulsifying a core material containing a reactive substance like a color former, and then forming a wall of a macromolecular substance around the droplets of the core material to microencapsulate the core material. Therein, reactants to produce a macromolecular substance are added to the inside and/or the outside of the oily droplets. For details of microcapsules which can be preferably employed in the present invention, e.g., for production methods of microcapsules which can be preferably used, descriptions in Japanese Patent Application (OPI) No. 222716/84 (the term "OPI" as used herein means an "unexamined published application"), and so on can be referred to.

An organic solvent to constitute the above-described oily droplets can be properly selected from those used generally as pressure sensitive oil. In particular, the use of such an organic solvent as to be well suited for dissolution of color developers described hereinafter is desirable, because solubilities of leuco dyes therein are high, a color density of the developed image and a color development speed upon thermal printing can be increased thereby, and fog density upon thermal printing can be reduced thereby.

A preferred size of microcapsules to be employed in the present invention is 4 microns or less, particularly 2 micron or less, on a volume average basics according to the evaluation method described, e.g., in Japanese Patent Application (OPI) No. 214990/85.

Desirable microcapsules which are produced in the above-described manner are not those of the kind which are disrupted by heat or pressure, but those of the kind which have a microcapsule wall through which reactive substances present inside and outside the individual microcapsules respectively can be passed under a thermally fused condition to react with each other.

Multicolored neutral tints can be effected by preparing some kinds of microcapsules having walls differing in glass transition point through proper selection of wall materials, and optional addition of glass transition point controlling agents (e.g., plasticizers described in Japanese Patent Application No. 119862/85) to the wall materials, respectively, and further by combining selectively colorless precursors of basic dyes differing in hue with their respective color developers. Therefore, the present invention is not limited to a monochromatic heat sensitive paper, but can be applied to a two-color or multicolor heat sensitive paper and a heat sensitive paper suitable for recording of graded image.

In addition, a photodiscoloration inhibitor as described, e.g., in Japanese Patent Application Nos. 125470/85, 125471/85 and 125472/85 can be added, if desired.

Color developers to be employed in the present invention, which undergo the color development reaction with basic colorless dyes in a thermally fused condition, can be those selected properly from known color developers. For instance, suitable examples of color developers to be combined with leuco dyes include phenol compounds, triphenylmethane compounds, sulfur-contained phenolic compounds, carboxylic acid compounds, sulfon compounds, urea or thiourea compounds, and so on. Details of the color developers are described, e.g., in "Kami Pulp Gijutsu Times, pp. 49–54, and pp. 65–70 (1985)". Of such color developers, those having melting points of 50° to 250° C., particularly phenols and organic acids which have melting points of 60° to 200° C. and are hardly soluble in water, are preferred over others. Combined use of two or more of color developers is desirable because of increase in solubility.

Color developers preferred particularly in the present invention are represented by the following general formulae (I) to (IV):

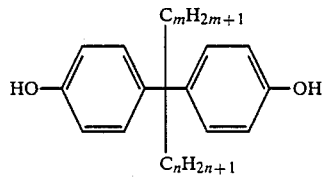

(I)

m=0–2, n=2–11

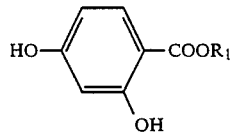

(II)

$R_1$ is an alkyl group, an aryl group, or an aralkyl group. In particular, methyl, ethyl and butyl groups are preferred as $R_1$.

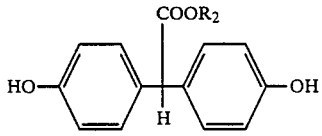

(III)

$R_2$ is an alkyl group. In particular, butyl group, pentyl group, heptyl group, and octyl group are preferred as $R_2$.

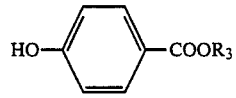

(IV)

$R_3$ is an alkyl group, or an aralkyl group.

In the present invention, such a color developer is used in a form of emulsified dispersion. The dispersion can be prepared by dissolving color developers in an organic solvent slightly soluble or insoluble in water, and mixing the resulting solution with an aqueous phase which contains a surface active agent, and a water-soluble high polymer as a protective colloid to emulsify and to disperse the solution in the aqueous phase.

An organic solvent to be used for dissolving the color developers can be properly selected from those generally employed as pressure sensitive oil. Preferred examples of such oils include compounds represented by the following general formula (V) to (VII), triarylmethanes (such as tritoluylmethane, toluyldiphenylmethane, and the like), terphenyl compounds (such as terphenyl), alkylated diphenyl ethers (such as propyldiphenyl ether), hydrogenated terphenyl compounds (such as hexahydroterphenyl), diphenyl ethers, and so on.

Of these oils, esters are particularly preferred in the present invention from standpoints of stabilization of emulsified dispersion of the color developers and dissolving ability for the color developers.

(V)

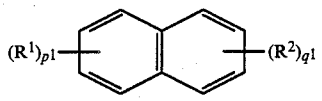

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less. Preferred alkyl groups represented by $R^1$ and $R^2$ are those containing 1 to 8 carbon atoms.

(VI)

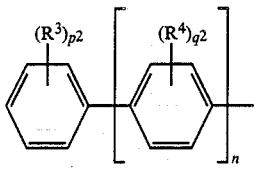

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of n=1, while it is 6 or less in case of n=2.

(VII)

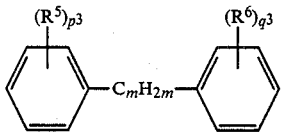

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented $R^5$ and, $R^6$, those containing 2 to 4 carbon atoms are particularly preferred.

Specific examples of the compounds represented by the formula (V) include dimethylnaphthalene, diethylnaphthalene, diisopropylnaphthalene, and the like.

Specific examples of the compounds represented by the formula (VI) include dimethylbiphenyl, diethylbiphenyl, diisopropylbiphenyl, diisobutylbiphenyl, and the like.

Specific examples of the compounds represented by the formula (VII)include 1-methyl-1-dimethylphenyl-1-phenylmethane, 1-ethyl-1-dimethylphenyl-1-phenylmethane, 1-propyl-1-dimethylphenyl-1-phenylmethane, and the like.

Specific examples of esters include phosphates (e.g.,-triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethylbenzoate, propyl benzoate, butyl benzoate, isopentyl benzoate, benzyl benzoate), abietates(e.g., ethyl abietate, benzyl abietate), dioctyl adipate, isodecyl succinate, dioctyl azelate, oxalates (e.g., dibutyl oxalate, dipentyl oxalate), diethyl malonate, fmaleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters); triacetin, diethylcarbonate, diphenylcarbonate, ethylenecarbonate, propylenecarbonate, boric acid esters (e.g., tributyl borate, tripentyl borate). Of these esters, it is particularly preferred to use tricresyl phosphate from the standpoint of stabilization of emulsified dispersion of the color developers.

The above-cited oils can be used as a mixture of two or more thereof, or in combination with other oils.

Further, auxiliary solvents, which have low boiling points and act as dissolution aid, can be added to the foregoing organic solvents in the present invention. As examples of particularly preferred auxiliary solvents, mention may be made of ethyl acetate, isopropyl acetate, butyl acetate, methylene chloride, and the like.

Water soluble high polymers to be contained as a protective colloid in an aqueous phase, which is to be mixed with an oily phase wherein color developers are dissolved, can be selected properly from known anionic, nonionic or amphoteric high polymers. Of these high polymers, polyvinylalcohol, gelatin, cellulose derivatives and the like are preferred.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium laurylbenzenesulfonate), sodium dioctylsulfosuccinates, polyalkylene glycols (such as polyoxyethylene nonylphenyl, ether) and so on.

An emulsified dispersion of color developers to be used in the present invention can be prepared with ease by mixing an oily phase containing the color developers and an aqueous phase containing a protective colloid and a surface active agent with a general means for preparing a fine grain emulsion, such as a high-speed stirrer, an ultrasonic disperser or so on, to disperse the former phase into the latter phase.

To the emulsified dispersion thus obtained, melting point depressants for the color developers can be added, if desired. Some of these melting point depressants have such a function as to control glass transition points of the capsule walls described hereinbefore, too. Specific examples of such melting point depressants include hydroxy compounds, carbamate compounds, sulfonamide compounds, aromatic methoxy compounds and so on. Details of these compounds are described in Japaneses Patent Application No. 244190/84.

These melting point depressants can be used in an amount of 0.1 to 2 parts by weight, preferably 0.5 to 1 part by weight, per 1 part by weight of color developer whose melting point is to be depressed. It is to be desired that the melting point depressant and the color developer, whose melting point can be depressed thereby, should be used in the same place. When they are added to separate places, a preferred addition amount of the melting point dispersant is 1 to 3 times of that of the above-described one.

For the purpose of prevention of sticking to a thermal head, and improvement on writing quality, pigments such as silica, barium sulfate, titanium oxide, aluminium hydroxide, zinc oxide, calcium carbonate, etc., styrene beads, or fine particles of urea/melamine resin and so on can be added to the heat sensitive recording material of the present invention. In order to keep the transparency of the heat sensitive layer, it is to be desired that the above-described pigments and so on should be added to a protective layer which is provided on the heat sensitive layer in a conventional manner for the purpose of acquisition of keeping quality and stability. Details of the protective layer are described in "Kami Pulp Gijitsu Times", pp. 2 to 4 (September 1985).

Also, metal soap can be added for the purpose of prevention of the sticking phenomenon. They are used at a coverage of 0.2 to 7 g/m$^2$.

The heat sensitive recording material can be formed using a coating technique with the aid of an appropriate binder.

As for the binder, various kinds of emulsions, such as a polyvinyl alcohol emulsion, a methyl cellulose emulsion, a carboxymethyl cellulose emulsion, a hydroxypropyl cellulose emulsion, a gum arabic emulsion, a gelatin emulsion, a polyvinyl pyrrolidone emulsion, a casein emulsion, a styrene-butadiene latex, an acrylonitrile-butadiene latex, a polyvinyl acetate emulsion, a polyacrylate emulsion, an ethylene-vinyl acetate copolymer emulsion, and so on, can be employed. An amount of the binder used is 0.5 to 5 g per square meter on a solids basis.

The heat sensitive recording material is produced by providing a heat sensitive layer on a support, such as paper, a synthetic resin film, etc., coating and drying a coating composition, in which microcapsules enclosing a color former therein and a dispersion containing at least a color developer in an emulsified condition are contained as main components, and further a binder and other additives are incorporated, according to a conventional coating method, such as a bar coating method, a blade coating method, an air knife coating method, a gravure coating method, a roll coating method, a spray coating method, a dip coating method, or so on. A coverage of the heat sensitive layer is controlled to 2.5 to 25 g/m$^2$ on a solids basis. It is a surprise to find that thus prepared heat sensitive layer has very excellent transparency, though the reason for its transparency is not elucidated.

As for the paper to be used as a support, neutralized paper which is sized with a neutral sizing agent like an alkylketene dimer and shows pH 6–9 upon hot extraction is employed to advantage in the respect of long-range preservation.

In order to prevent the penetration of a coating composition into paper, and in order to effect a close contact between a heat recording head and a heat sensitive recording layer, paper described in Japanese Patent Application (OPI) No. 116687/82, which is characterized by Stökigt sizing degree/(meter basis weight)$^2 \geqq 3 \times 10^{-3}$ and Bekk smoothness of 90 seconds or more, is used to advantage.

In addition, paper having optical surface roughness of 8 microns or less and a thickness of 40 to 75 microns, as described in Japanese Patent Applicaiotn (OPI) No. 136492/83; paper having a density of 0.9 g/cm$^3$ or less and optical contact rate of 15% or more, as described in Japanese Patent Application (OPI) No. 69097/83; paper which is prepared from pulp having received a beating treatment till its freeness has come to 400 cc or more on a basis of Canadian Standard Freeness (JIS P8121) to prevent permeation of a coating composition thereinto, as described in Japanese Patent Application (OPI) No. 69097/83; raw paper made with a Yankee paper machine, which is to be coated with a coating composition on the glossy side and thereby, improvements on developed color density and resolution are intended, as described in Japanese Patent Application (OPI) No. 65695/83; raw paper which has received a corona discharge processing and thereby, its coating aptitude has been enchanced, as described in Japanese Patent Application (OPI) No. 35985/84; and so on can be employed in the present invention, and can bring about good results. In addition to the above-described papers, all supports which have so far been used for general heat sensitive recording papers can be employed as the support of the present invention.

The heat sensitive recording material of the present invention has heat sensitivity high enough to enable the image formation using a thermal head of facsimile or the like, notwithstanding the transparence of its heat sensitive layer. Accordingly, when a transparent film is used as the support of the present material, the resulting material can have such a usage that the material receives image information by means of facsimile, and is submitted immediately to projection with an overhead projector. Moreover, when the present material is so designed as to function as multicolor recording material, color images developed are excellent in sharpness and color reproduction because they are free from the influences which the opacity of a heat sensitive layer exercises on image qualities.

EXAMPLES

The present invention is illustrated in greater detail by reference to the following examples. However, the invention should not be construed as being limited to these examples.

EXAMPLE 1

Preparation of Capsule Solution 14 g of Crystal Violet lactone (leuco dye), 60 g of Takenate D 110N (Traade name of capsule wall material, produced by Takeda Yakuhin K.K.) and 2 g of Sumisoap 200 (Trade name of ultraviolet absorbent, produced by Sumitomo Kagaku K.K.) were added to a mixed solvent consisting of 55 g of 1-phenyl-1-xylylethane and 55 g of methylene chloride, and dissolved therein. The solution of the above-described leuco dye was mixed with an aqueous solution constituted with 100 g of a 8% water solution of polyvinyl alcohol, 40 g of water and 1.4 g of a 2% water solution of sodium dioctylsulfosuccinate (dispersant), and emulsified with stirring at 10,000 r.p.m. for 5 minutes using Ace Homogenizer made by Nippon Seiki K.K. Then, the resulting emulsion was diluted with 150 g of water, and allowed to stand at 40° C. for 3 hours to conduct the microencapsulation reaction therein. Thus, a solution containing microcapsules having a size of 0.7 micron was obtained.

Preparation of Color Developer-emulsified Dispersion

The color developers (a), (b) and (c) represented by the structural formulae illustrated below were added in amounts of 8 g, 4 g and 30 g, respectively, to a solvent mixture of 8.0 g 1-phenyl-1-xylylethane and 30 g of ethyl acetate, and dissolved thereinto. The thus obtained solution of the color developers was mixed with 100 g of a 8% water solution of polyvinyl alcohol, 150 g of water and 0.5 g of sodium dodecylbenzensulfonate, and emulsified with stirring at 10,000 r.p.m. for 5 minute at ordinary temparature using Ace Homogenizer made by Nippon Seiki k.k. to prepare an emulsified dispersion having a grain size of 0.5 micron.

Color Developer (a)

Zinc Salt of

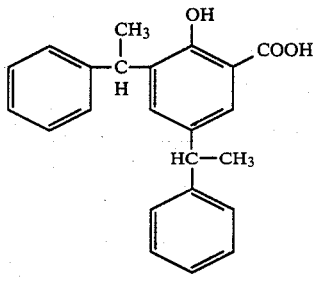

Color Developer (b)

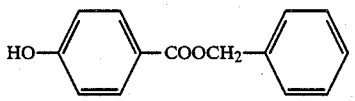

Color Developer (c)

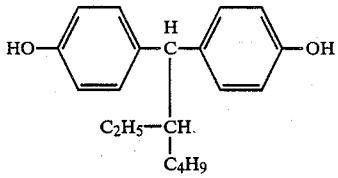

Production of Heat Sensitive Material

A 5.0 g portion of the foregoing capsule solution, a 10.0 g portion of the foregoing color developer-emulsified dispersion and 5.0 g of water were mixed with stirring, coated on a 70 μ-thick transparent polyethylene terephthalate (PET) film support at a coverage of 15 g/m$^2$ on a solids basis, and dried. Thereon, a 2 μ-thick protective layer having the following composition was further provided to produce a transparent heat sensitive film.

Composition of Protective Layer

| | |
|---|---|
| 10% Polyvinyl Alcohol | 20 g |
| Water | 30 g |
| 2% sodium Dioctylsulfosuccinate | 0.3 g |
| Kaolin Dispersion (prepared by dispersing 3 g of polyvinyl alcohol, 100 g of water and 35 g of kaolin with a ball mill) | 3 g |
| Hidolin Z-7 (Trade name of product of Chukyo Yushi K. K. ) | 0.5 g |
| | 0.5 g |

Printing was carried out on the thus obtained heat sensitive material using Mitsubishi Melfas 600 (Trade name of facsimile machine manufactured by Mitsubishi Denki K.K. (GIII mode)) to develop a blue image. The density of the developing image measured by a Macbeth transmission densitometer was 0.7. The obtained image was able to submitted to projection with an overhead projector as it was.

EXAMPLE 2

A transparent black image having a Macbeth transmission density of 0.6 was obtained in the same manner as in Example 1 except that 2-anilino-3-methyl-6-N-ethyl-N-butylaminofluoran was used in place of Crystal Violet lactone.

EXAMPLE 3

A transparent blue image having a Macbeth transmission density of 0.7 was obtained in the same manner as in Example 1 except that a combination of 25 g of the color developer (c) and 10 g of Sumilizer W X-R (Trade name of product of Sumitomo Kagaku K.K.) was employed in place of the combination of the color developers (a), (b) and (c).

EXAMPLE 4

A transparent blue image having a Macbeth transmission density of 0.7 was obtained in the same manner as in Example 1 except that 100 g of a 10% aqueous solution of gelatin was employed in place of the 8% aqueous solution of polyvinyl alcohol.

COMPARATIVE EXAMPLE 1

In place of the color developer-emulsified dispersion used in Example 1, the following ingredients were dispersed with a ball mill to prepare a dispersion having a grain size of 2 microns.

| | |
|---|---|
| Polyvinyl Alcohol | 5 g |
| Color Developer (a) | 4 g |
| Color Developer (b) | 2 g |
| Color Developer (c) | 15 g |
| Water | 100 g |

Then, a 5 g portion of the leuco dye capsule solution prepared in Example 1, a 9 g portion of the foregoing color developer dispersion, and 5 g of water were mixed to prepare a coating composition. The coating composition was coated on a 70 μ-thick transparent PET film at a coverage of 15 g/m$^2$ on a solids basis, and dried.

The heat sensitive material obtained was inferior in transparency, and was translucent in appearance. The thus obtained heat sensitive material was submitted to thermal printing of characters, and then to projection with an overhead projector. As the result of projection, it was difficult to read the character images because of their obscurity.

EXAMPLE 5

Color developer-emulsified dispersions were prepared in the same manner as one prepared in Example 1 except that (2) diethyl maleate, (3) dibutyl maleate and (4) the compound represented by the following formula,

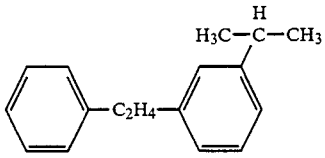

were used in place of (1) 1-phenyl-1-xylylethane, respectively.

Each of the thus obtained color developer-emulsified dispersions was diluted with ⅓ time as much water as the dispersion, stirred for 12 hours with a stirrer, and then coated on a PET base. The surface condition of each coat was observed with the eyes and thereby, comparison of extents of emulsification stability were made among the four kinds of color developer-emulsified dispersions.

| Oraganic Solvent | Emulsification Stability |
|---|---|
| (1) | good |
| (2) | very excellent |
| (3) | very excellent |
| (4) | no good (condensed in part upon stirring with a stirrer) |

The above results demonstrate that the use of organic solvents as cited in the present specification, especially maleic acid esters, can contribute greatly to stabilization of the emulsified condition of the color developers.

EXAMPLE 6

A heat sensitive material was prepared in the same manner as in Example 1 except that the color developer-emulsified dispersion prepared in the same manner as in Example 5, in which diethyl maleate was used as the organic solvent, was employed in place of the color developer-emulsified dispersion prepared in Example 1, and the protective layer having the following composition was used in place of the protective layer provided in Example 1.

Composition of Protective Layer

| | |
|---|---|
| Silica-denatured Polyvinyl Alcohol (PVA R 2105; Trade name of product of Kurare K. K. | 1 pt. wt. (on solids basis) |
| Colloidal Silica (Snowtex 30; Trade name of product of Nissan Kagaku K. K. | 1.5 pts. wt. (on solids basis) |
| Zinc Stearate (Hidolin; Trade name of product of Chukyo Yushi K. K. | 0.02 pt. wt. (on solids basis) |
| Paraffin Wax (Hidolin P-7; Trade name of product of Chukyo Yushi K. K.) | 0.02 pt. wt. (on solids basis) |

Images were recorded on the thus obtained heat sensitive material in the same manner as in Example 1, and the transmission density of 0.7 was obtained. The recorded images were able to be submitted to projection with an overhead projector as they were.

EXAMPLE 7

The same result was obtained in the same manner as in Example 1 except that a mixed solution of 2.0 g of 1-phenyl-1-xylylethane, 6.0 g of dibutylphthalate and 30 g of ethylacetate was used instead of the mixed solution of 8.0 g of 1-phenyl-1-xylylethane and 30 g of ethylacetate to prepare color developer-emulsified dispersion.

EXAMPLES 8–18 and COMPARATIVE EXAMPLE 2

Transparent black images were obtained in the same manner as in Example 1 except that oils listed in Table 1 were used instead of 1-phenyl-1-xylylethane and dibutylphthalate to prepare color developer-emulsified dispersion.

TABLE 1

| Example No. | Oil | Macbeth Transmission Density | Emulsification Stability |
|---|---|---|---|
| 8 | tricresylphosphate | 0.53 | very excellent |
| 9 | tricresylphosphate/ diethylmaleate | 0.61 | very excellent |
| 10 | di-isodecylphthalate | 0.60 | good |
| 11 | dibutylphthalate | 0.61 | good |
| 12 | dioctyladipate | 0.62 | good |
| 13 | dioctylazelate | 0.59 | good |
| 14 | dibutylfumarate | 0.57 | good |
| 15 | diphenylcarbonate | 0.57 | good |
| 16 | propylenecarbonate | 0.57 | good |
| 17 | diethylmaleate | 0.59 | good |
| 18 | dibutylmaleate | 0.59 | good |
| Comparative example 2 | compound A | 0.59 | no good |

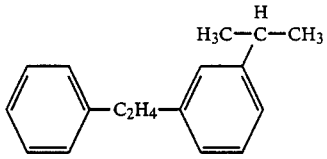

compound A

Each of the this obtained color developer-emulsified dispersions was diluted by adding 0.5 part of water, stirred for 6 hours with a stirrer, and then coated on a PET base. The surface condition of each was observed with the eyes and thereby, comparison of extents of emulsification stability were made. Results were shown in Table 1 together with a Macbeth transmission density of each sample.

What is claimed is:

1. A heat sensitive recording material which comprises a support having thereon a transparent heat sensitive layer containing at least color former-containing microcapsules and a color developer, said heat sensitive layer being formed using a colorless or light colored precursor of a basic dye as said color former, and according to a process which comprises preparing a coating composition by mixing said microcapsules with an emulsified dispersion prepared by dissolving at least the color developer into an organic solvent slightly soluble or insoluble in water to form an organic phase and then dispersing said organic phase in an aqueous phase containing a protective colloid to form an emulsified composition, coating the resulting composition on the support, and then drying the coat.

2. A heat sensitive recording material as claimed in claim 1, wherein said organic solvent, in which a color developer is dissolved, contains at least one ester.

3. A heat sensitive recording material as claimed in claim 2, wherein said organic solvent, in which a color developer is dissolved, is at least one ester.

4. A heat sensitive recording material as claimed in claim 1, wherein said organic solvent, in which a color developer is dissolved, is at least one solvent selected from compounds represented by a following general formula;

(V)

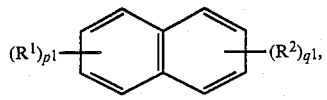

wherein $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less.

5. A heat sensitive recording material as claimed in claim 1, wherein said organic solvent, in which a color developer is dissolved, is at least one solvent selected from compounds represented by a following general formula;

(VI)

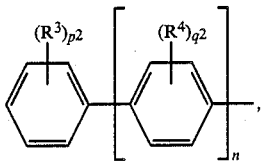

wherein $R^3$ represents a hydrogen atom, or an alkyl group containing 1 to 12 carbon atoms, $R^4$ represents an alkyl group containing 1 to 12 carbon atoms, and n is 1 or 2, $p^2$ and $q^2$ each represents an integer of 1 to 4, provided that the total number of alkyl groups is 4 or less in case of n=1, while it is 6 or less in case of n=1.

6. A heat sensitive recording material as claimed in claim 1, wherein said organic solvent, in which a color developer is dissolved, is at least one solvent selected from compounds represented by a following general formula;

(VII)

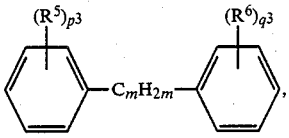

wherein $R^5$ and $R^6$, which may be the same or different, each represents a hydrogen atom, or an alkyl group containing 1 to 18 carbon atoms; m represents an integer of 1 to 13; $p^3$ and $q^3$ each represents an integer of 1 to 3, provided that the total number of alkyl groups is 3 or less.

7. A heat sensitive recording material as claimed in any one of claims 1 to 6, wherein a transparent film is employed as the support.

8. A heat sensitive recording material as claimed in claim 1, said recording material further containing pigments, and wherein said pigments are contained only in a protective layer provided on the heat sensitive layer.

* * * * *